US011692418B2

(12) United States Patent
Zhang et al.

(10) Patent No.: US 11,692,418 B2
(45) Date of Patent: Jul. 4, 2023

(54) INFLOW CONTROL DEVICE, METHOD AND SYSTEM

(71) Applicants: Zhihui Zhang, Katy, TX (US); Bin Zhu, Houston, TX (US); Guijun Deng, The Woodlands, TX (US); Zhiyue Xu, Cypress, TX (US); Ronnie Russell, Cypress, TX (US)

(72) Inventors: Zhihui Zhang, Katy, TX (US); Bin Zhu, Houston, TX (US); Guijun Deng, The Woodlands, TX (US); Zhiyue Xu, Cypress, TX (US); Ronnie Russell, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/351,718

(22) Filed: Jun. 18, 2021

(65) Prior Publication Data

US 2022/0403719 A1 Dec. 22, 2022

(51) Int. Cl.
*E21B 43/12* (2006.01)
*E21B 43/38* (2006.01)

(52) U.S. Cl.
CPC ..... *E21B 43/12* (2013.01); *E21B 43/38* (2013.01)

(58) Field of Classification Search
CPC ..... E21B 43/12; E21B 43/38; E21B 43/385; B04C 2003/003
See application file for complete search history.

(56) References Cited

U.S. PATENT DOCUMENTS 3,719,207 A * 3/1973 Takeda ..... B65G 53/521 366/181.8
3,813,854 A * 6/1974 Hortman ..... B04C 3/00 55/447
4,531,584 A * 7/1985 Ward ..... E21B 43/38 166/265
4,563,279 A * 1/1986 Wright ..... B03B 5/626 210/512.1
6,036,749 A * 3/2000 Ribeiro ..... B01D 21/2494 96/216
6,997,214 B2 * 2/2006 Kuo ..... F15D 1/02 366/338
7,673,678 B2 3/2010 Macdougall et al.
8,361,208 B2 * 1/2013 Hill ..... B21C 37/15 96/216

(Continued)

FOREIGN PATENT DOCUMENTS

CH 692326 A5 * 5/2002 ..... B01F 24/43151
WO WO 9015256 * 12/1990 ..... B01D 21/26

(Continued)

OTHER PUBLICATIONS

Gurses, Sule et al., "Dynamic Modeling and Design Optimization of Cyclonic Autonomous Inflow Control Devices" SPE Paper No. 193824-MS; Apr. 10, 2019; 15 pages.

(Continued)

*Primary Examiner* — Blake Michener
(74) *Attorney, Agent, or Firm* — Cantor Colburn LLP

(57) ABSTRACT

A flow control device including a flow channel having a housing defining an inside surface, the inside surface having an irregular helical structure of constant orthogonal cross-sectional dimensions.

16 Claims, 5 Drawing Sheets

(56) References Cited

U.S. PATENT DOCUMENTS

| | | | | |
|---|---|---|---|---|
| 8,376,047 | B2 | 2/2013 | Dykstra et al. | |
| 8,403,038 | B2 | 3/2013 | Russell et al. | |
| 8,527,100 | B2 | 9/2013 | Russell et al. | |
| 9,441,462 | B2 | 9/2016 | Chakraborty et al. | |
| 10,633,956 | B2 | 4/2020 | Vachon | |
| 2005/0217489 | A1* | 10/2005 | Tovar Depablos | E21B 43/38 96/208 |
| 2006/0196658 | A1* | 9/2006 | Belcher | E21B 17/22 166/244.1 |
| 2007/0028984 | A1* | 2/2007 | Caro | F16L 11/121 138/DIG. 11 |
| 2007/0157985 | A1* | 7/2007 | Caro | A61F 2/06 138/40 |
| 2009/0084714 | A1* | 4/2009 | Schook | B01D 19/0057 209/639 |
| 2009/0139938 | A1* | 6/2009 | Larnholm | B04C 3/00 210/512.3 |
| 2009/0173545 | A1* | 7/2009 | Shotton | E21B 21/01 175/310 |
| 2009/0277650 | A1* | 11/2009 | Casciaro | E21B 43/12 166/386 |
| 2012/0097038 | A1* | 4/2012 | Hill | B01D 19/0052 96/216 |
| 2014/0246206 | A1 | 9/2014 | Least et al. | |
| 2015/0021019 | A1* | 1/2015 | Veit | E21B 43/08 166/250.15 |
| 2016/0160616 | A1 | 6/2016 | Moen et al. | |
| 2017/0044868 | A1 | 2/2017 | Van Petegem et al. | |
| 2020/0370382 | A1 | 11/2020 | Gohari et al. | |
| 2020/0377801 | A1* | 12/2020 | Indurain Y Urricelqui | C10G 9/20 |

FOREIGN PATENT DOCUMENTS

| | | | | |
|---|---|---|---|---|
| WO | WO-2010070289 | A2 * | 6/2010 | E21B 43/36 |
| WO | 2020247325 | A1 | 12/2020 | |

OTHER PUBLICATIONS

Lee Axial Visco Jets; The Lee Company; www.theleeco.com/products; retrieved Apr. 29, 2021; 3 pages.

Notification of Transmittal of the International Search Report and the Written Opinion of the International Searching Authority, or the Declaration; PCT/US2022/073020; dated Oct. 4, 2022; 11 pages.

* cited by examiner

INFLOW CONTROL DEVICE, METHOD AND SYSTEM

BACKGROUND

In the resource recovery and fluid sequestration industries, flow control devices and particularly inflow control devices (ICD) are often needed to reduce breakthrough of unwanted fluids into a production tubular or into a formation. ICDs rely on pressure drop to distribute flow and upon viscosity of fluids to assist in separation of different fluids to help selectively pass correct fluids. This works well for many situations but where viscosity of desired and undesired fluids is close, such ICDs do a poor job of separation. Hence the art would well receive ICDs that effectively provide pressure drop and selective passage of fluids where viscosity varies only minimally among various fluids.

SUMMARY

An embodiment of a flow control device including a flow channel having a housing defining an inside surface, the inside surface having an irregular helical structure of constant orthogonal cross-sectional dimensions.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
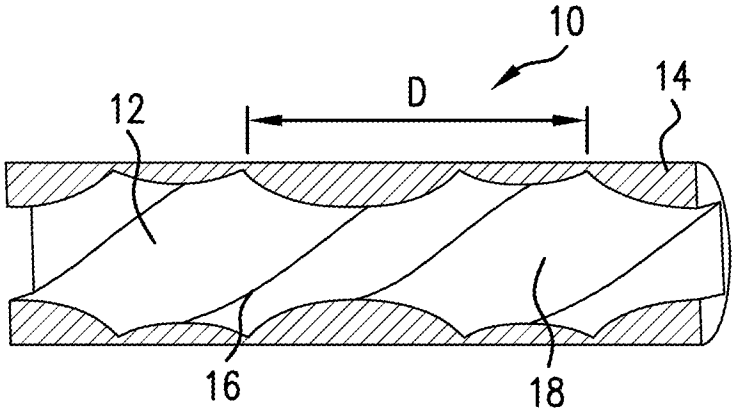
FIG. 1 is a longitudinal cross-sectional view of a flow channel of a flow control device as disclosed herein.

Referring to FIG. 1, a flow channel 12 of a flow control device (ICD) 10 (FIG. 3), comprises a housing 14 and a structure 16 defined at an inside surface 18 of the housing 14. Housing 14 maybe a separate structure or may be a part of some other structure as desired. For purposes of enabling this disclosure, the housing need merely be a structure that can define and inside surface (i.e. 18) and therefore may be a tubular member or could be the housing of some other tool with the channel 12 being created within the material of that housing.

Figure 2:
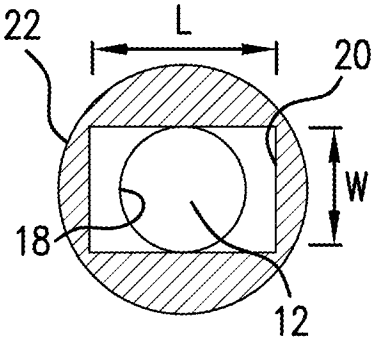
FIG. 2 is an end view of the flow channel illustrated in FIG. 1.

Referring to FIGS. 1 and 2 together will help in understanding the geometry of the flow channel 12 at the inside surface 18. In longitudinal cross section the geometry appears complex but when viewing the end of the channel 12 in FIG. 2, the inside surface 18 becomes clearer. The geometry of the inside surface 18 is created by using a rectangular geometry opening 20. That rectangle is then moved longitudinally through the channel 12 and rotated simultaneously. At every orthogonal cross section of the channel 12 there will be an outside surface 22 of channel 12 and the inside surface 18. The inside surface will be exactly the same in shape at each cross section but will be at different orientations. Picking any orientation to be a starting orientation, on full revolution of the rectangle will give two cross sections that are the same in appearance and will be spaced from one another by a distance that is related to the longitudinal displacement of the rectangle along the longitudinal axis of the channel 12. The displacement distance is a pitch, just like a thread pitch, is roughly helical, and in embodiments might be a 3 pitch or a 5 pitch, though others are also contemplated. The inside surface 18 then defines an irregular helical structure of constant orthogonal cross-sectional dimensions The appearance of complexity of the surface 18 in FIG. 1 is due primarily to the fact that the rectangle used to generate that shape has differing length and width. Other non-circular geometries are also contemplated, such as, for example, triangular, oval, pentagonal, etc. Flow channel 12 may be most easily manufactured by an additive process but certainly may also be created using a subtractive process.

Figure 3:
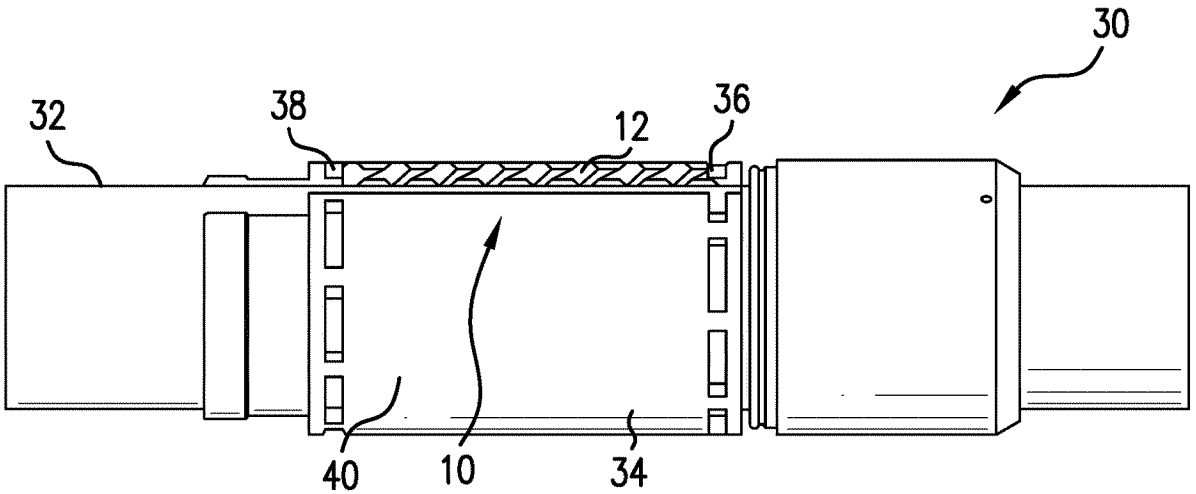
FIG. 3 is a side view of a tool body having the flow channel shown in FIG. 1 disposed axially parallel thereto.

Referring to FIG. 3, a downhole tool 30 is illustrated that includes the flow channel 12 as a part of the inflow control device 10. The tool includes a mandrel 32 about which is disposed a body 34, which may be in the form of a sleeve, that incorporates the ICD 10. ICD 10 comprises an inlet 36 and an outlet 38 with the channel 12 fluidly connecting the inlet 36 to outlet 38. Channel 12 is integrated into the sleeve 34 in this view but could also be attached to an outside surface 40 of the sleeve 34, if desired. If attached to the outside surface 40, the flow channel 12 may have the appearance of FIG. 1, being a tubular member attached to the sleeve 34 in common ways.

Figure 4:
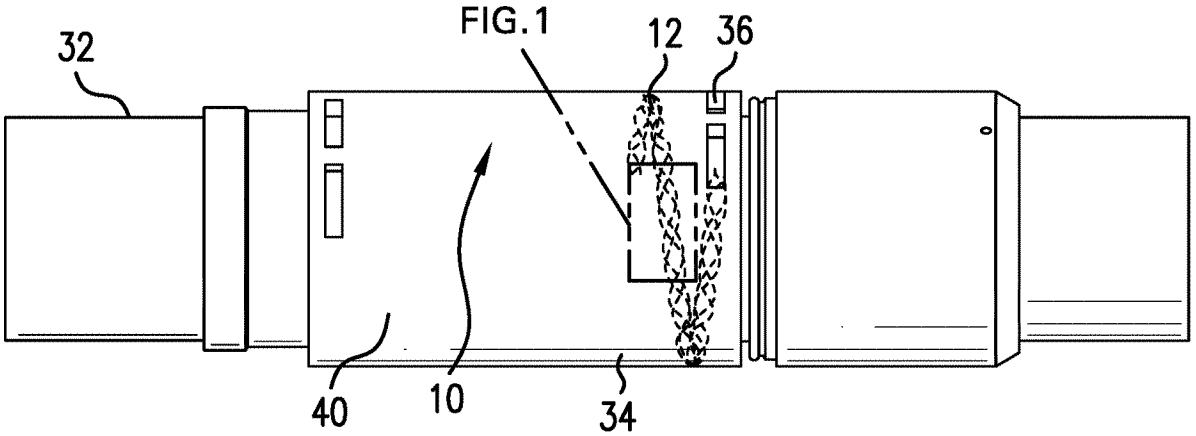
FIG. 4 is a side view of a tool body having the flow channel shown in FIG. 1 disposed helically about the body.

Referring to FIG. 4, an alternative configuration employs the channel 12 in a helical arrangement about the sleeve 34. In this embodiment, like that of FIG. 3, the channel 12 may be incorporated into the wall thickness of the sleeve 34 or may be attached to the outside surface 40 thereof.

Figure 5:
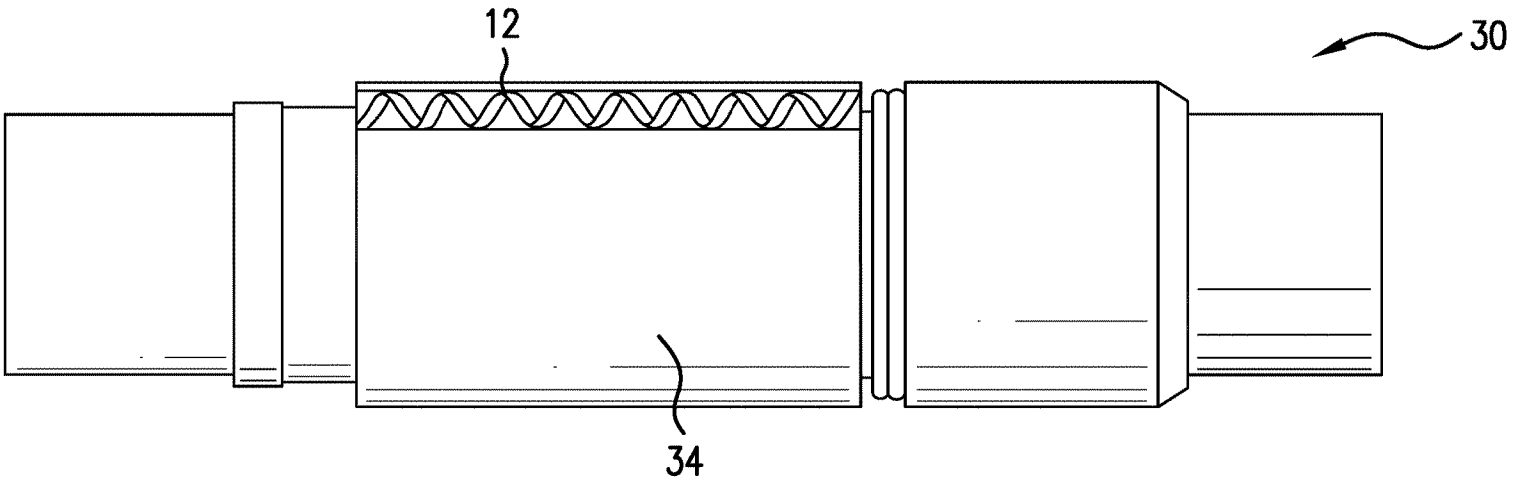
FIG. 5 is a side view of a tool body having the flow channel shown in FIG. 1 disposed helically within a thickness of a wall of the body.

In yet another embodiment, referring to FIG. 5, the channel 12 is disposed helically within a wall thickness of sleeve 34, not around the sleeve 34 like in FIG. 4, but rather along one or more longitudinal segments of the sleeve 34.

Figure 6:
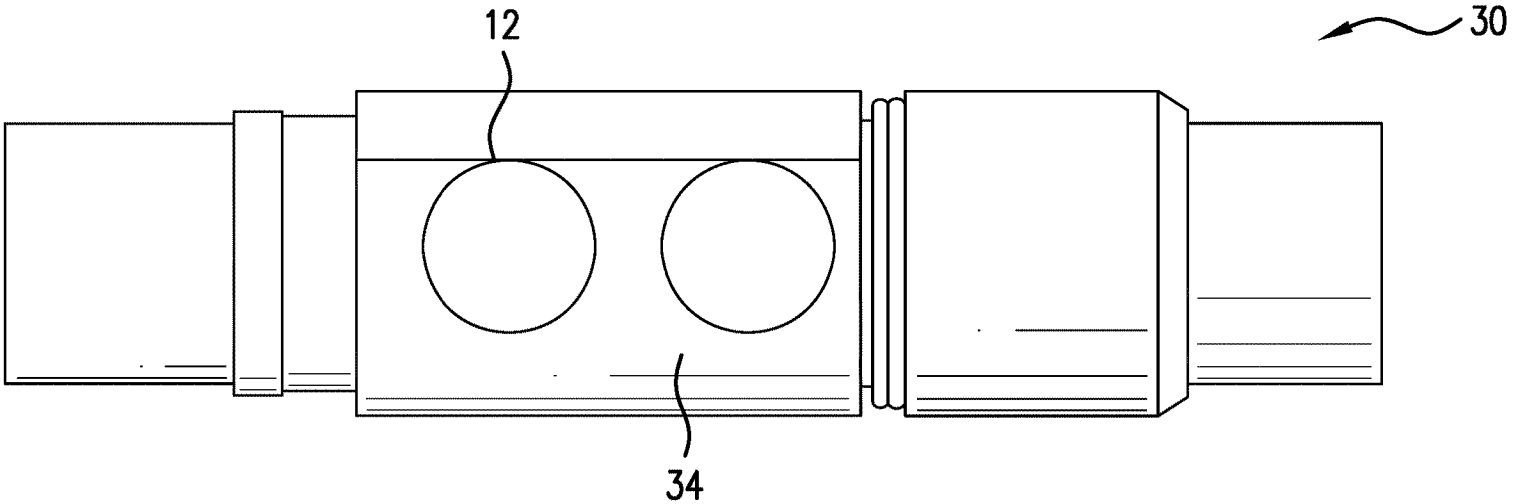
FIG. 6 is a side view of a tool body having the flow channel shown in FIG. 1 disposed in a looped pattern within a thickness of a wall of the body.

Referring to FIG. 6, another embodiment is illustrated wherein the flow channel 12 has a looped geometry and yet is still fully contained within the wall thickness of sleeve 34.

In each case, the flow channel 12 functions to spin fluid flowing therethrough which tends to throw denser fluid to an outer portion of the channel 12 to preferentially pass more desirable fluid. The inside surface 18 also creates turbulence in the fluid when undesirable denser fluid is flowing therethrough. The turbulence increases pressure drop through flow channel 12 and together with the rotational effect on flow, improves production of desirable fluid while inhibiting production of undesirable denser fluid even when the fluids have viscosities that are close to one another.

In the helical pathway embodiments of FIGS. 4 and 5, there is an additional benefit in that while the effects discussed in the paragraph directly above continue to persist in the embodiments of FIGS. 4 and 5, the overall helical pathway of the flow channel 12 will tend to throw denser liquid to the outside of the helical pathway. This is in addition to the results of spinning the fluid within the flow channel 12. Additional pressure drop for the system is created by the helical pathway that is additive to the pressure drop created by the internal geometry of the flow channel 12.

In FIG. 6, the looped geometry lengthens the flow channel 12 achieving greater pressure drop capabilities.

Figure 7:
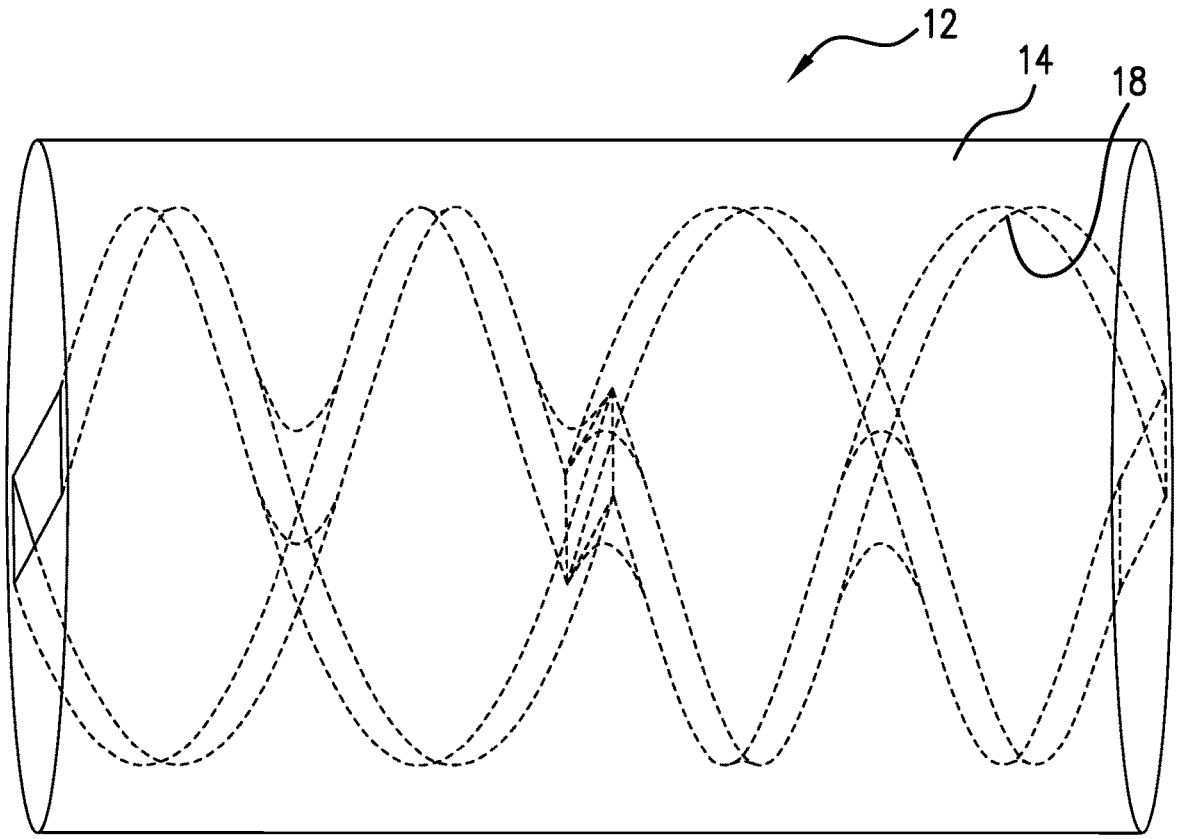
FIG. 7 is a longitudinal cross section of an alternate flow channel embodiment.
Figure 8:
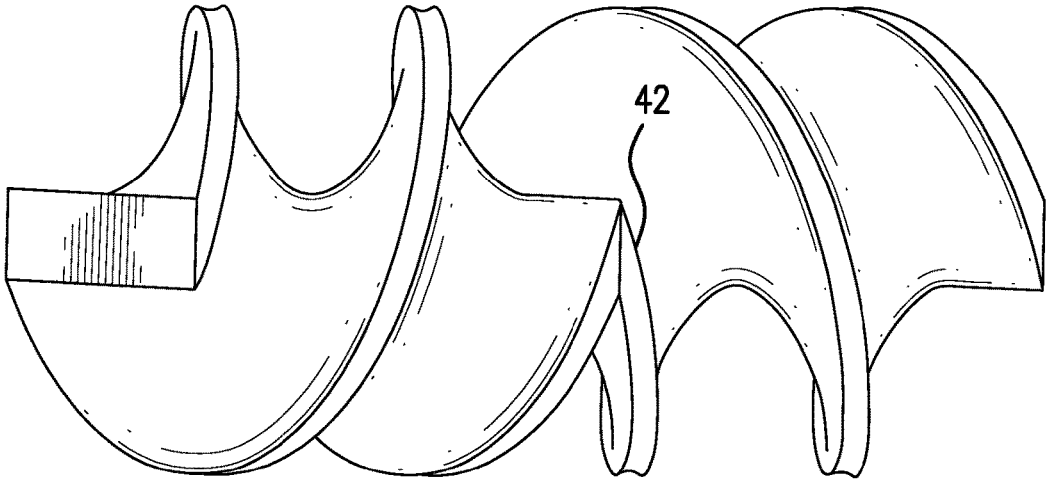
FIG. 8 is a representation of the flow channel shown in FIG. 7 but illustrated by making what is hollow in FIG. 7 appear solid and without the housing for clarity of the shape of the flow pathway.

Referring to FIGS. 7 and 8, another embodiment of the flow channel 12 is illustrated. This embodiment is similar to that illustrated in FIG. 1 but includes a reversal of direction of the helix. While this may be appreciated in FIG. 7, it might be more easily appreciated from FIG. 8 where the illustration is a negative of the inside surface 18. In other words, the inside surface 18 of the housing 14 becomes the outside surface of the illustration of FIG. 8, simply to show what the flow void in FIG. 7 actually looks like. It can be easily understood that the direction of the rotating geometric form has reversed at transition point 42. Any number of reversals is contemplated and distance between reversals is adjustable as desired. The shape shown in FIG. 8 may be applied to each embodiment of a pathway shown herein and to others.

Figure 9:
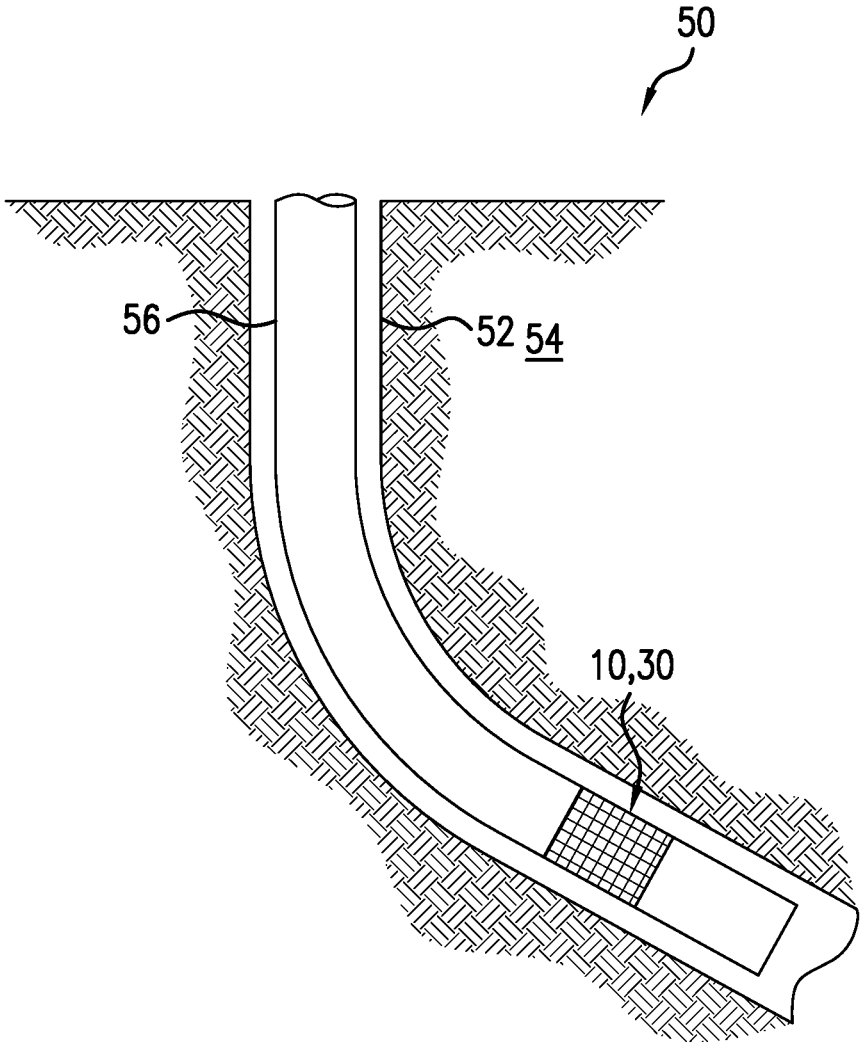
FIG. 9 is an illustration of a wellbore system including the flow channel illustrated in FIG. 1.

Referring to FIG. 9, a wellbore system 50 is disclosed. The system 50 includes a borehole 52 in a subsurface formation 54. A string 56 is disposed in the borehole 52. An ICD 10 is disposed within or as a part of the string 56.

Set forth below are some embodiments of the foregoing disclosure:

Embodiment 1: A flow control device including a flow channel having a housing defining an inside surface, the inside surface having an irregular helical structure of constant orthogonal cross-sectional dimensions.

Embodiment 2: The device as in any prior embodiment, wherein a geometry of the flow channel causes separation of the axial flow effects and the rotational flow effects based upon density of fluids flowing therethrough.

Embodiment 3: The device as in any prior embodiment, wherein the surface selectively facilitates flow through of desired fluid.

Embodiment 4: The device as in any prior embodiment, wherein the constant orthogonal cross-sectional dimensions define a noncircular closed geometric shape that is rotated at each cross-sectional plane while moving through the housing.

Embodiment 5: The device as in any prior embodiment, wherein the closed geometric shape is a rectangle.

Embodiment 6: The device as in any prior embodiment, wherein the surface includes a pitch.

Embodiment 7: The device as in any prior embodiment, wherein the pitch is one of a 3 or 5 pitch.

Embodiment 8: The device as in any prior embodiment, wherein the helical structure reverses direction along a longitudinal direction thereof.

Embodiment 9: The device as in any prior embodiment, wherein the flow channel is elongated and extends in parallel to a longitudinal axis of a body adjacent to or encompassing the housing.

Embodiment 10: The device as in any prior embodiment, wherein the flow channel is elongated and extends about a body adjacent to or encompassing the housing.

Embodiment 11: The device as in any prior embodiment, wherein the flow channel extends helically about the body.

Embodiment 12: The device as in any prior embodiment, wherein the flow channel extends helically within a thickness of the body.

Embodiment 13: The device as in any prior embodiment, wherein the flow channel extends in a looped geometry.

Embodiment 14: The device as in any prior embodiment, wherein the looped geometry is within a thickness of the body.

Embodiment 15: A method for controlling inflow of fluid including flowing fluid into a flow volume as in any prior embodiment, rotating the fluid, and separating denser fluid components.

Embodiment 16: The method as in any prior embodiment, further comprising axially conveying the fluid while the fluid is rotating.

Embodiment 17: The method as in any prior embodiment, further including preferentially conveying a selected density fluid.

Embodiment 18: A wellbore system including a borehole in a subsurface formation; a string in the borehole; an inflow control device as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A flow control device comprising:

a flow channel having a housing defining an inside surface, the inside surface having an irregular helical structure defined by a rotated non circular closed geometric shape of constant dimensions moved along a longitudinal direction of the flow channel.

2. The device as claimed in claim 1 wherein the closed geometric shape is a rectangle.

3. The device as claimed in claim 1 wherein the helical structure reverses direction along a longitudinal direction thereof.

4. The device as claimed in claim 1 wherein the flow channel is elongated and extends in parallel to a longitudinal axis of a body adjacent to or encompassing the housing.

5. The device as claimed in claim 1 wherein the flow channel is elongated and extends about a body adjacent to or encompassing the housing.

6. The device as claimed in claim 5 wherein the flow channel extends helically about the body.

7. The device as claimed in claim 5 wherein the flow channel extends helically within a thickness of the body.

8. The device as claimed in claim 5 wherein the flow channel extends in a looped geometry.

9. The device as claimed in claim 8 wherein the looped geometry is within a thickness of the body.

10. A method for controlling inflow of fluid comprising:

flowing fluid into a flow channel as claimed in claim 1;

rotating the fluid; and separating denser fluid components.

11. The method as claimed in claim 10 further comprising axially conveying the fluid while the fluid is rotating.

12. The method as claimed in claim 10 further including preferentially conveying a selected density fluid.

13. The method as claimed in claim 10 further comprising throwing denser fluid outwardly in the flow channel.

14. The method as claimed in claim 10 further comprising creating turbulence in denser fluid.

15. The method as claimed in claim 14 further comprising causing a pressure drop through the flow channel with turbulence.

16. A wellbore system comprising:

a borehole in a subsurface formation;

a string in the borehole;

an inflow control device as claimed in claim 1 disposed within or as a part of the string.

* * * * *